US008740306B2

(12) United States Patent
Tuckey et al.

(10) Patent No.: US 8,740,306 B2
(45) Date of Patent: Jun. 3, 2014

(54) CHAIR STRUCTURE AND METHOD OF ASSEMBLING THE SAME

(75) Inventors: Peter R. Tuckey, Morgantown, PA (US); Jonathan K. Mountz, Elverson, PA (US)

(73) Assignee: Nuna International, B.V., Amsterdam (NL)

( * ) Notice: Subject to any disclaimer, the term of this patent is extended or adjusted under 35 U.S.C. 154(b) by 627 days.

(21) Appl. No.: 12/954,861

(22) Filed: Nov. 27, 2010

(65) Prior Publication Data

US 2012/0133185 A1 May 31, 2012

(51) Int. Cl.
*A47C 3/18* (2006.01)
*A47C 1/00* (2006.01)

(52) U.S. Cl.
USPC ..... 297/344.22; 297/440.22; 297/451.5

(58) Field of Classification Search
USPC ..... 297/344.21, 440.1, 440.22, 451.4, 297/451.5, 344.22, 344.26
See application file for complete search history.

(56) References Cited

U.S. PATENT DOCUMENTS 4,236,752 A 12/1980 Mizelle
4,872,635 A * 10/1989 Knoblock et al. ..... 248/406.2
4,928,620 A * 5/1990 Currey ..... 114/363
4,977,848 A * 12/1990 Currey ..... 114/363
5,383,644 A * 1/1995 Huse ..... 248/523
5,385,323 A * 1/1995 Garelick ..... 248/161
5,431,362 A * 7/1995 Carnahan et al. ..... 248/159
6,116,183 A * 9/2000 Crow et al. ..... 114/363
6,877,811 B1 * 4/2005 Garelick ..... 297/344.22

FOREIGN PATENT DOCUMENTS

EP 2127560 A1 12/2009
JP 55163873 5/1954
JP 56006256 6/1954
JP 5957157 4/1984
JP 0378693 8/1991
JP 2007236874 A 9/2007
TW 244003 M 8/1992
WO 2007056655 A1 5/2007

* cited by examiner

*Primary Examiner* — David R Dunn
*Assistant Examiner* — Tania Abraham
(74) *Attorney, Agent, or Firm* — David I. Roche; Baker & McKenzie LLP

(57) ABSTRACT

A chair structure comprises a seat frame having a first coupling element, a support base, and a pivot link assembly mounted on the support base. The pivot link assembly includes a pivot axle, and a second coupling element pivotally mounted around the pivot axle. The second coupling element includes a latch operable to lock the first coupling element with the second coupling element when the seat frame is assembled with the support base, and unlock the first coupling element from the second coupling element for allowing separation of the seat frame from the support base.

24 Claims, 7 Drawing Sheets

CHAIR STRUCTURE AND METHOD OF ASSEMBLING THE SAME

BACKGROUND

1. Field of the Invention

The present invention relates to chair structures and methods of assembling chair structures.

2. Description of the Related Art

A conventional chair structure usually includes a seat portion that is assembled on a support structure. To allow convenient use, certain chair structures may also include a pivoting mechanism that allows rotation of the seating portion relative to the support structure, such that a user can push the seat portion in rotation while remaining seated on the seat portion. However, the pivoting mechanism usually employed in the convention chair does not permit disassembly of the chair structure. As a result, when the chair is not used, the chair cannot be stored in a compact form.

Therefore, there is presently a need for a chair structure that can be easily assembled and disassembled, and address at least the foregoing issues.

SUMMARY

The present application describes a system and method for assembling the chair structure.

According to one embodiment, the chair structure comprises a seat frame having a first coupling element, a support base, and a pivot link assembly mounted on the support base. The pivot link assembly includes a pivot axle, and a second coupling element pivotally mounted around the pivot axle, wherein the second coupling element includes a latch operable to lock the first coupling element with the second coupling element when the seat frame is assembled with the support base, and unlock the first coupling element from the second coupling element for allowing separation of the seat frame from the support base.

The present application also describes a method for assembling the chair structure. In one embodiment, the method comprises providing a seat frame having a first coupling element having a hole, providing a support base having a pivot axle and a second coupling element pivotally mounted around the pivot axle, wherein the second coupling element includes a latch thereon, and assembling the seat frame with the support base by sliding the first coupling element over the second coupling element until the latch engages through the hole for locking the first coupling element with the second coupling element.

At least one advantage of the chair structure and method described herein is the ability of the seat frame to assemble with and separate from the support base in a convenient manner. Storage of the chair structure can be thereby facilitated.

The foregoing is a summary and shall not be construed to limit the scope of the claims. The operations and structures disclosed herein may be implemented in a number of ways, and such changes and modifications may be made without departing from this invention and its broader aspects. Other aspects, inventive features, and advantages of the invention, as defined solely by the claims, are described in the non-limiting detailed description set forth below.

DETAILED DESCRIPTION OF THE EMBODIMENTS

The present application describes a chair structure and a method for assembling the chair structure. Examples of use of the chair structure described herein may include, without limitation, a chair for seating a young infant or baby.

Figure 1:
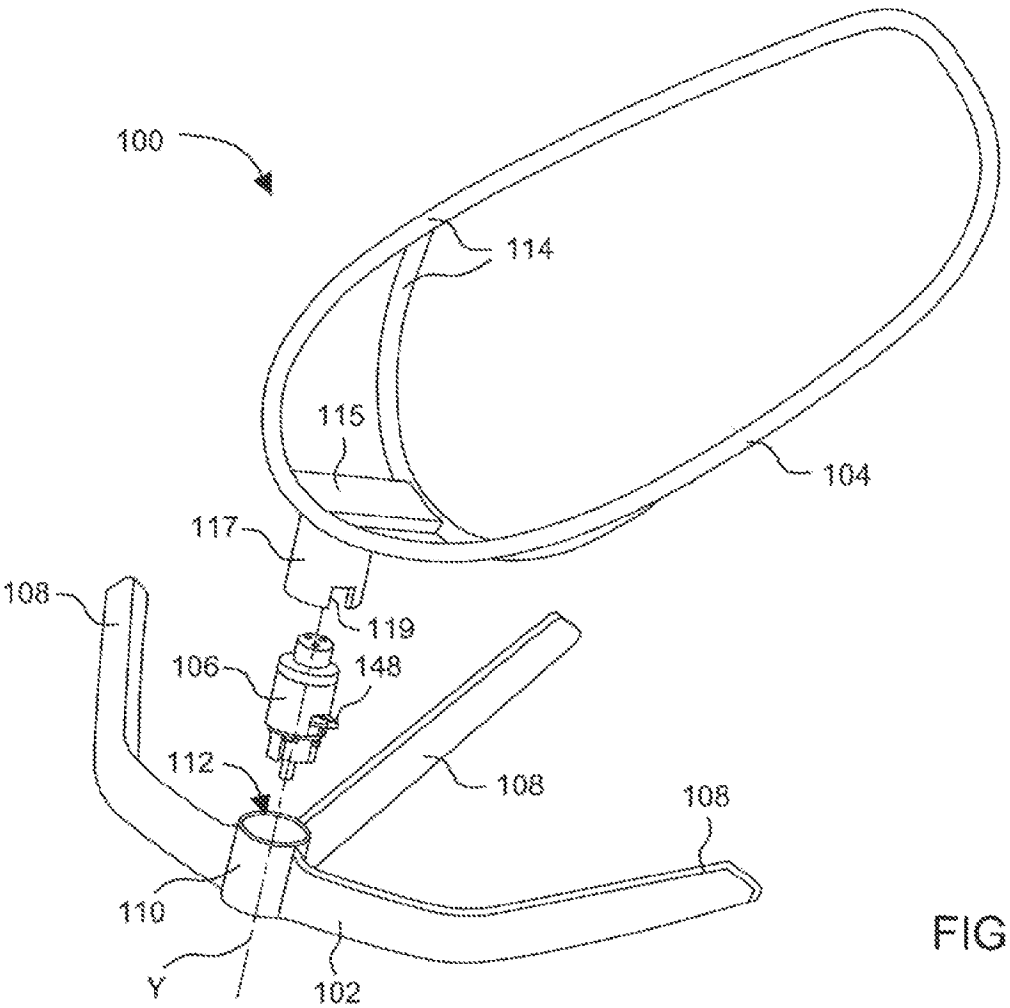
FIG. 1 is an exploded view illustrating a seat frame and support base of a chair structure according to one embodiment of the present invention.
Figure 2:
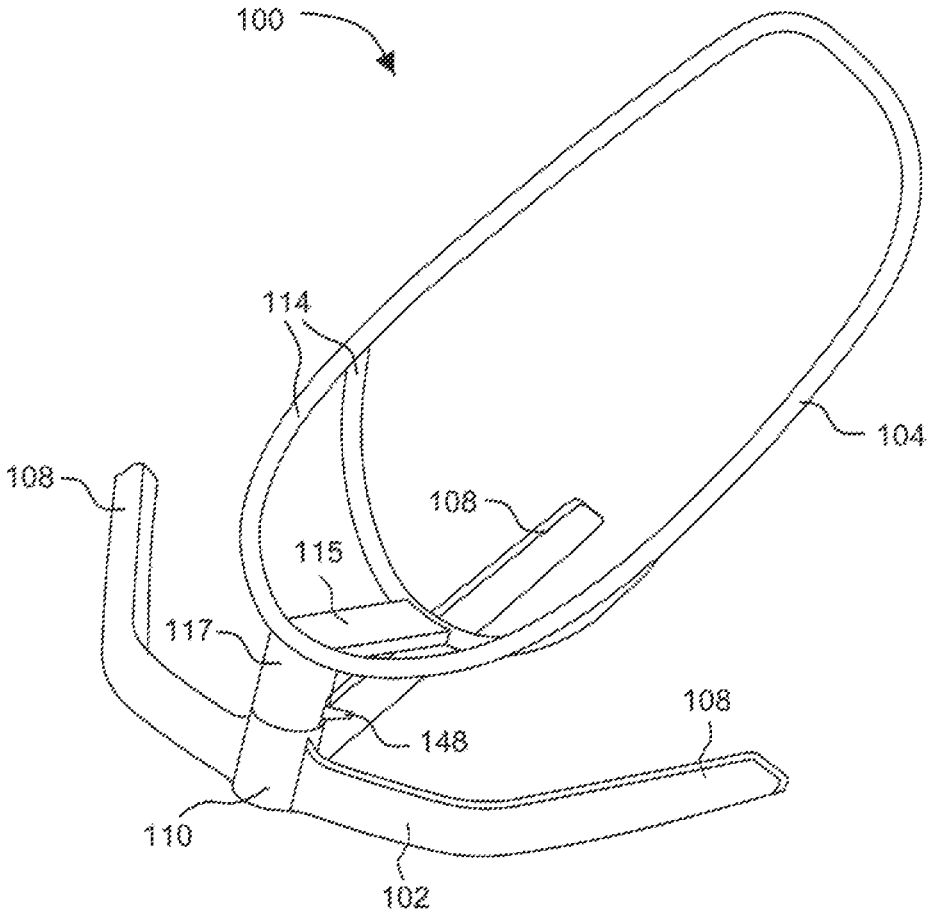
FIG. 2 is a perspective view of a chair structure according to one embodiment of the present invention.

FIGS. 1 and 2 are respectively exploded and perspective views illustrating one embodiment of a chair structure 100. The chair structure 100 comprises a support base 102, a seat frame 104, and a pivot link assembly 106 mounted on the support base 102. The support base 102 may include a plurality of resting beams 108 that extend radial from a joint portion 110 for providing stable support of the chair structure 100 on a floor. The joint portion 110 of the support base 102 has an inner cavity 112 in which the pivot link assembly 106 is fixedly mounted. The seat frame 104 may include a tubular structure 114 having a bracket 115 and a first coupling element 117 affixed on the bracket 115. In one embodiment, the first coupling element 117 may be formed as an enclosing cup having a hollow inner volume in which the pivot link assembly 106 can be received when the seat frame 104 is assembled on the support base 102. In particular, a side of the first coupling element 117 can include a slot 119 that is able to engage with a second coupling element 122 (e.g., shown in FIG. 3) provided on the pivot link assembly 106 for enabling rotation of the seat frame 104 relative to the support base 102 about a rotation axis Y defined by the pivot link assembly 106.

Figure 3:
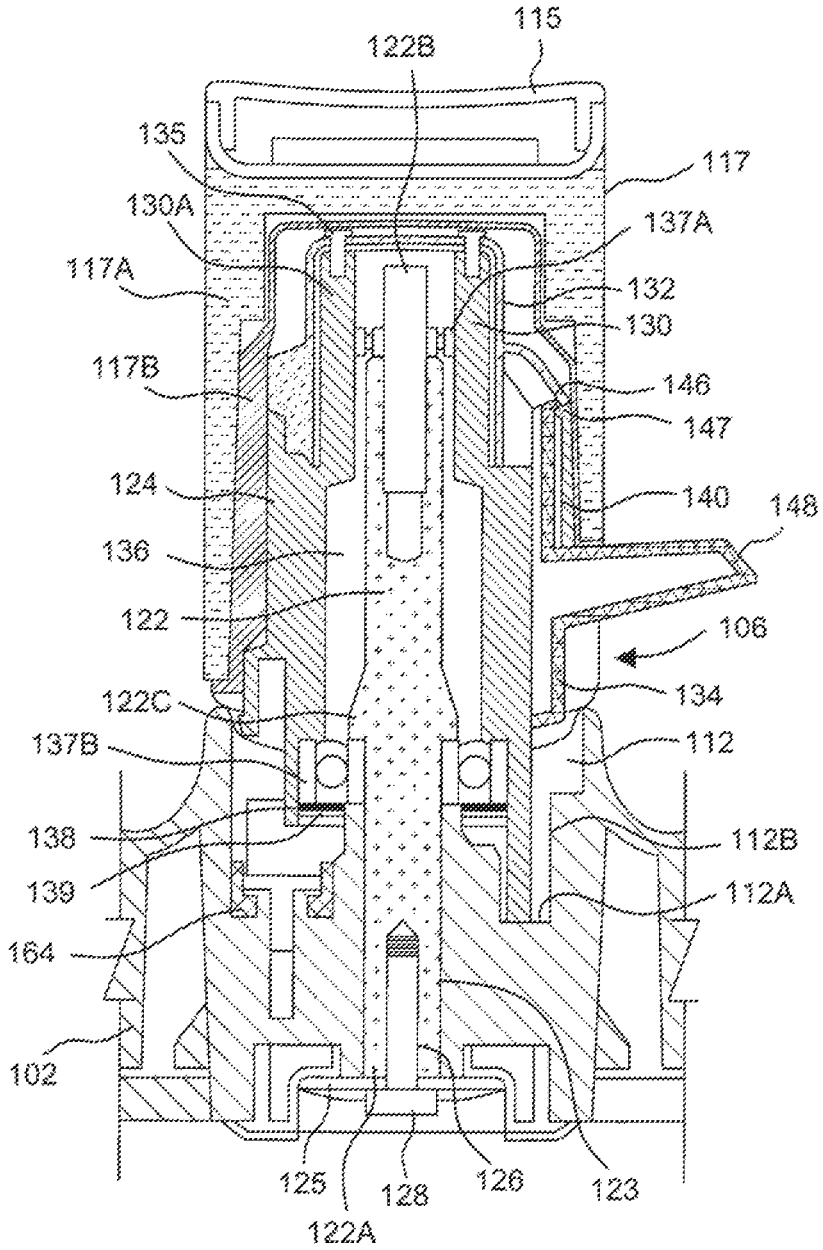
FIG. 3 is a schematic cross-sectional view illustrating a pivot link assembly implemented in a chair structure according to an embodiment of the present invention.
Figure 4:
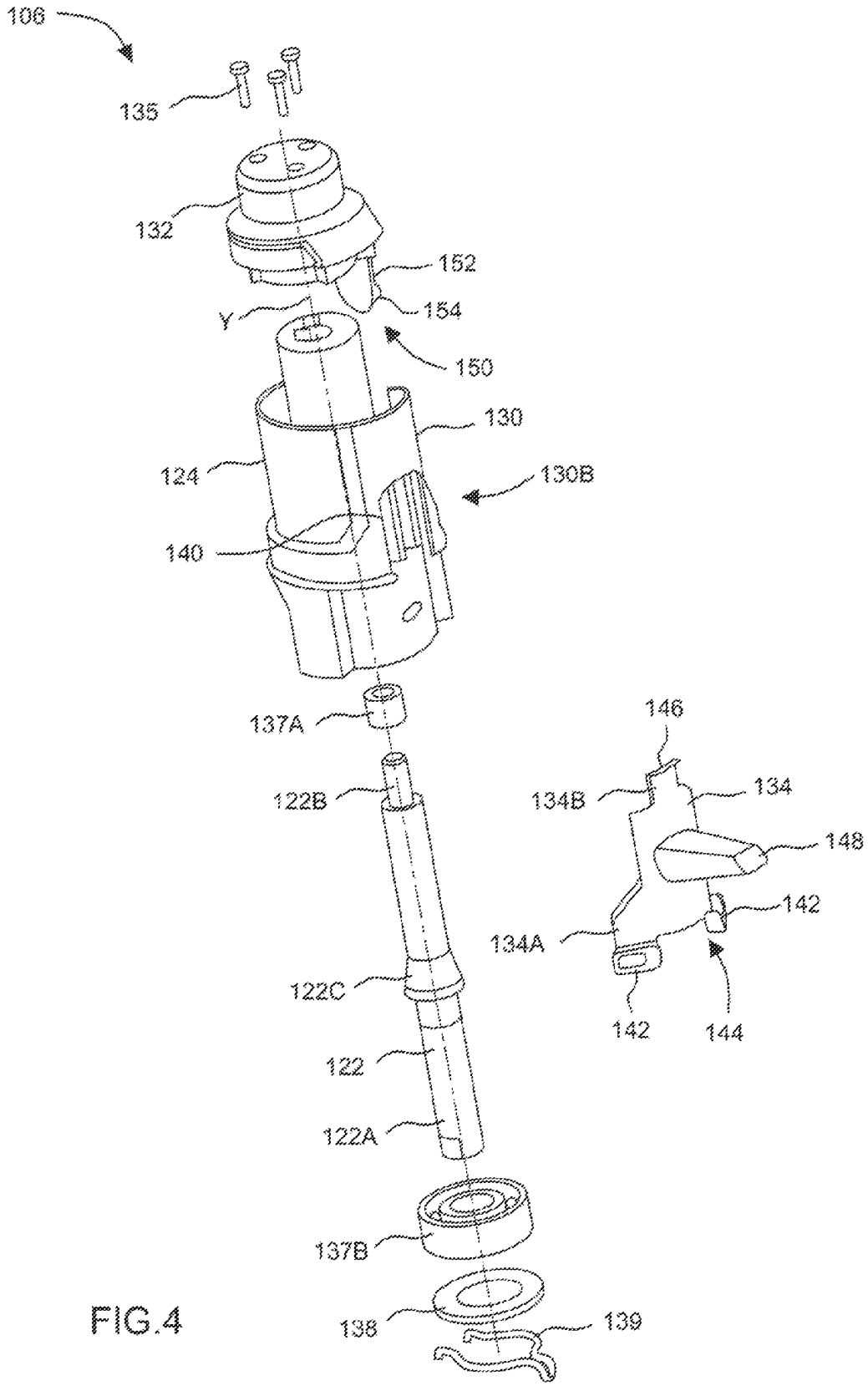
FIG. 4 is an exploded view of the pivot link assembly shown in FIG. 3.
Figure 5:
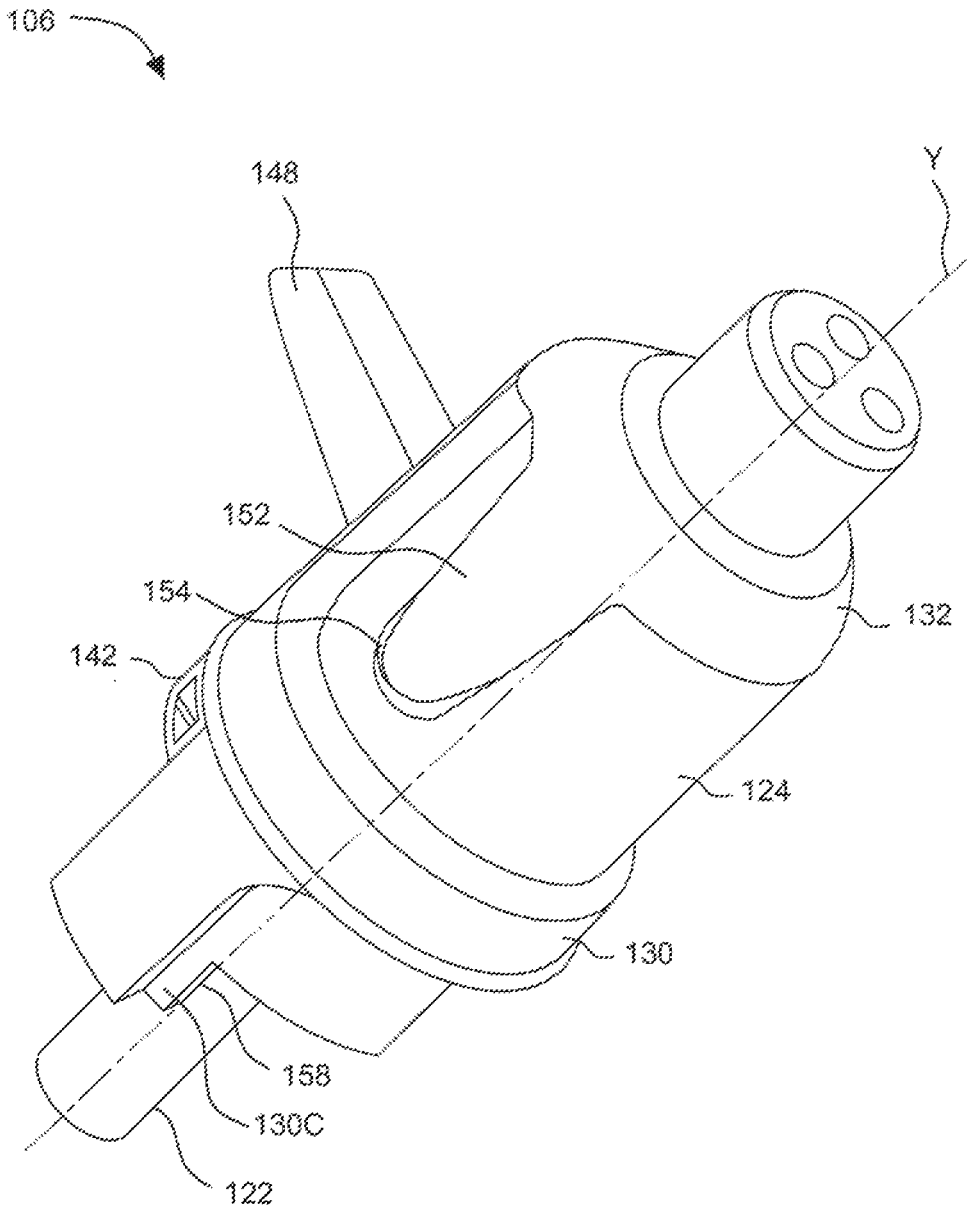
FIG. 5 is a perspective of the pivot link assembly shown in FIG. 4

FIGS. 3-5 are respectively cross-sectional, exploded and perspective views illustrating the construction of the pivot link assembly 106 and how it assembles with the support base 102 and first coupling element 117. As shown in FIG. 3, the first coupling element 117 may include an outer enclosing cup 117A in which is mounted an inner cup 117B having a hollow inner volume. Further, referring to FIGS. 3 and 4, the pivot link assembly 106 includes a pivot axle 122 that defines the rotation axis Y, and a second coupling element 124 pivotally mounted around the pivot axle 122. The pivot axle 122 has a first end 122A affixed in the inner cavity 112 of the support base 102. More particularly, the inner cavity 112 is at least partially delimited by a bottom surface 112A and sidewall 112B. A hole 123 is formed through the bottom surface 112A and is downwardly closed by an end cap 125. The first end 122A of the pivot axle 122 having a threaded hole 126 is assembled through the hole 123 and fixedly secured with the end cap 125 via a screw 128 that engages through the end cap 125 with the threaded hole 126.

The second coupling element 124 includes a sleeve 130, a cover 132 and an anti-rotation lock 134. The sleeve 130 has a hollow, generally elongated shape that has an inner bore 136 through which the pivot axle 122 is pivotally mounted via bearings 137A and 137B. The bearing 137A may be mounted adjacent to a top end 130A of the sleeve 130 and tightly fitted around a second end 122B of the pivot axle 122 opposite its first end 122A. The bearing 137B is tightly mounted around the pivot axle 122 in abutment against a shoulder portion 122C of the pivot axle 122, at an intermediate position between the first end 122A and second end 122B of the pivot axle 122. The inner bore 136 may be downwardly closed by a seal 138, which is fastened via a collar 139 against the bearing 137B at a side opposite the shoulder portion 122C. The seal 138 can prevent dust contamination through the lower end of the inner bore 136. The top end 130A of the sleeve 130 is closed with the cover 132 fixedly secured via screws 135.

As shown in FIGS. 3-5, a side 130B of the sleeve 130 forms a recessed, elongated pocket 140 through which the anti-rotation lock 134 is assembled in sliding relationship along the direction of the rotation axis Y. In one embodiment, the anti-rotation lock 134 may be formed as an elongated member slidably mounted through the pocket 140. A first end 134A of the anti-rotation lock 134 includes two restricting flanges 142 (better shown in FIG. 4) that are spaced apart from each other and delimit a gap 144 there between. A second end 134B of the anti-rotation lock 134 opposite its first end 134A includes a catch 146 that is able to detachably fasten with a rib 147 protruding inward from an inner sidewall of the sleeve 130 (better shown in FIG. 3). In addition, an intermediate portion of the anti-rotation lock 134 between the first end 134A and the second end 134B includes a handle 148 that extends radial from the direction of the rotation axis Y for engaging through the slot 119 of the first coupling element 117 (shown in FIG. 1). By pulling the handle 148 downward or upward, the anti-rotation lock 134 can slide vertically to either a first position or second position higher than the first position. As described hereafter, when the anti-rotation lock 134 is in the first position, the restricting flanges 142 of the anti-rotation lock 134 can be placed adjacent to two lateral sides of a protuberance 162 formed in the inner cavity 112 (better shown in FIG. 6) for blocking rotation of the seat frame 104 about the pivot axle 122. In the second position, the restricting flanges 142 are positioned in a gap above the protuberance 162 such that rotation of the seat frame 104 about the pivot axle 122 is allowed.

Referring again to FIGS. 4-5, the second coupling element 124 also includes a latch 150 that is provided on an outer side of the second coupling element 124. In one embodiment, the latch 150 may include a tab portion 152 extending downward from the cover 132, and a flange 154 protruding outward from the tab portion 152 and extending radial from the direction of the rotation axis Y. By resilient deflection of the tab portion 152 in a radial direction relative to the rotation axis Y, the flange 154 can engage through or disengage from a hole 156 provided through the first coupling element 117 (better shown in FIG. 7). When the latch 150 engages through the hole 156, the flange 154 can abut against a rim portion of the hole 156 for locking the first coupling element 117 with the second coupling element 124.

As shown in FIG. 5, a lower portion 130C of the sleeve 130 opposite the top end 130A includes two opposite abuttal flanges 158 (only one abuttal flange 158 is visible on FIG. 5) that are spaced-apart from each other and laid in different radial directions. When the seat frame 104 assembled on the support base 102 is rotated, either of the two abuttal flanges 158 can come in abutment against a stop element provided in the inner cavity 112 (better shown in FIG. 6) so as to delimit a maximum angle of rotation permitted for the seat frame 104.

Figure 6:
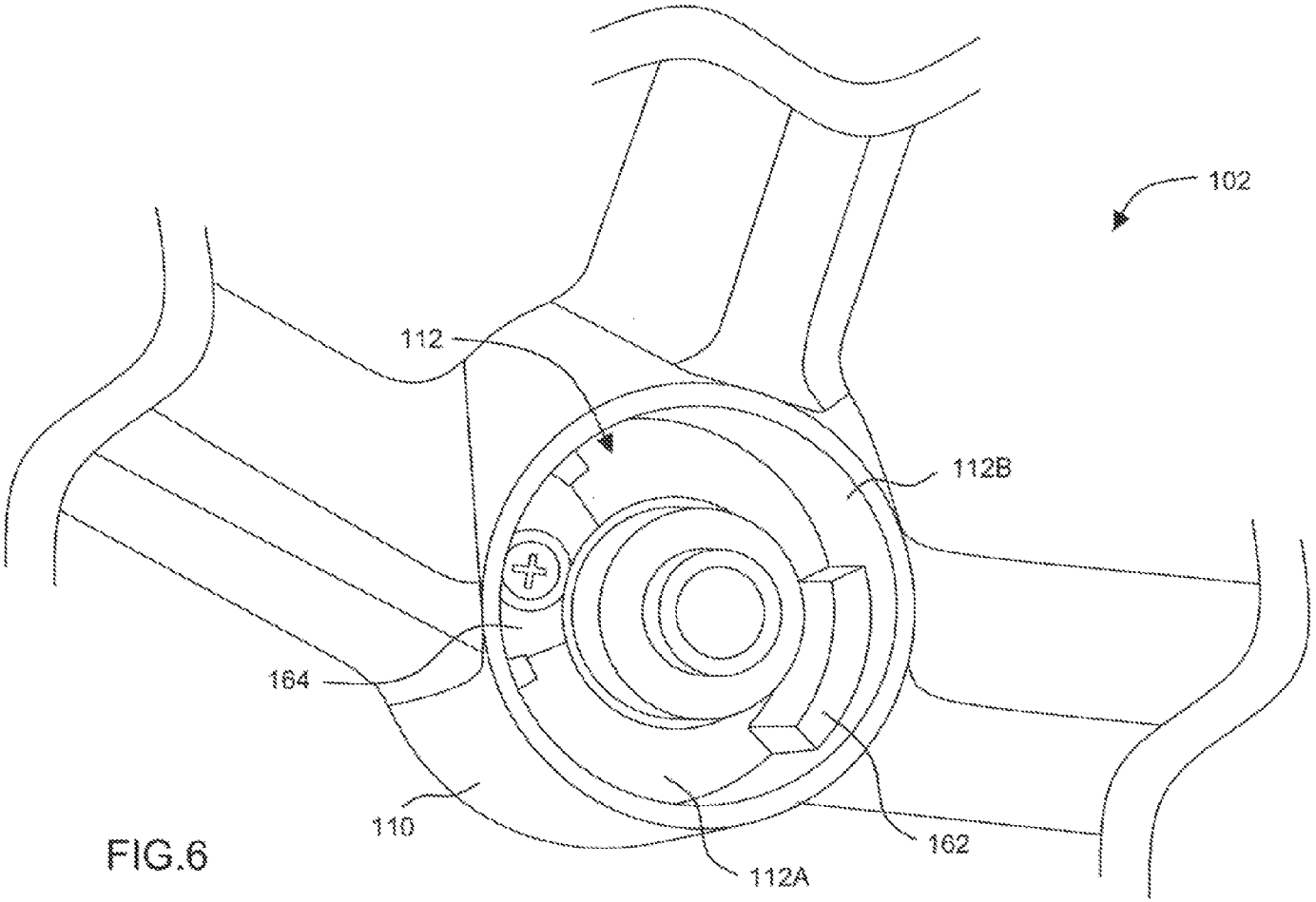
FIG. 6 is a schematic enlarged view of the support base shown in FIG. 1.

FIG. 6 is a schematic enlarged view illustrating the inner cavity 112 of the support base 102. As shown, the sidewall 112B surrounding the inner cavity 112 may have a generally cylindrical contour. The protuberance 162 against which the anti-rotation lock 134 abuts for blocking rotation of the seat frame 104 protrudes upward from the bottom surface 112A of the inner cavity 112. A cushion pad 164 is also fixed on the bottom surface 112A at a position diametrically opposite the protuberance 162. The cushion pad 164 is placed in an area located between the two abuttal flanges 158. The limits of the angular rotation permitted for the seat frame 104 are reached when either of the two abuttal flanges 158 comes in abutment against the cushion pad 164. The cushion pad 164 may be made of a flexible material adapted to cushion collision of the abuttal flanges 158 against the cushion pad 164 for stopping rotation of the seat frame 104.

It is worth noting that a variant embodiment can also configure the cushion pad 164 as a spring element (e.g., the cushion pad 164 may be made of a resilient material) that is loaded and provides a resilient force when it is pressed by the abuttal flange 158. When the abuttal flange 158 comes in contact with a first side of the cushion pad 164, the cushion pad 164 can deform and apply a counteracting force that causes the seat frame 104 to rotate in a reverse direction. The seat frame 104 can then rotate reversely until the opposite abuttal flange 158 comes in contact with an opposite second side of the cushion pad 164, which applies again a counteracting force to rotate the seat frame 104 toward the first side of the cushion pad 164. Accordingly, the seat frame 104 can bounce against the cushion pad 164 to perform reciprocated rotational movements, thereby providing an entertaining environment to the seated child.

Figure 7:
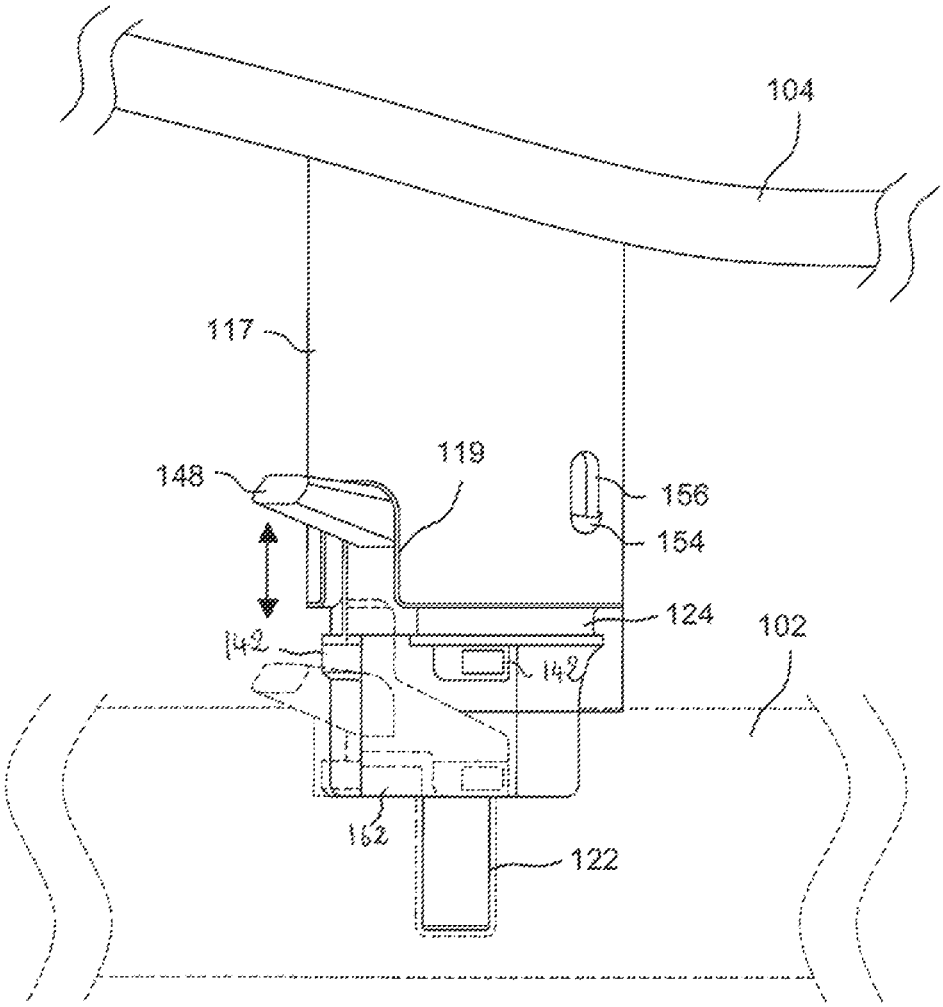
FIG. 7 is a schematic view illustrating an operation of the chair structure of FIG. 1.

Exemplary operation of the chair structure 100 is described hereafter with reference to FIGS. 3-7. The seat frame 104 can be assembled on the support base 102 by sliding the first coupling element 117 over the second coupling element 124 of the pivot link assembly 106. As shown in FIG. 7, the connection between the first coupling element 117 and the second coupling element 124 is then locked when the latch 150 engages through the hole 156 of the first coupling element 117. Moreover, the first coupling element 117 and the second coupling element 124 are also coupled with each other respectively via the engagement of the handle 148 through the slot 119 of the first coupling element 117, and the engagement between the slot 119 of the first coupling element 117 and outline protrusions of the elongated pocket 140. When rotation of the seat frame 104 is desired, the anti-rotation lock 134 can be raised until the catch 146 of the anti-rotation lock 134 engages and grips the rib 147 of the sleeve 130 by resilient deflection. The anti-rotation lock 134 can thereby be securely maintained at a higher position (i.e., the second position previously mentioned and shown with solid lines in FIG. 7) where the restricting flanges 142 are positioned in a gap above the protuberance 162. The seat frame 104 can then be rotated relative to the support base 102, which results in a unitary rotating movement of the first and second coupling elements 117 and 124 locked with each other around the pivot axle 122. In particular, the rotation movement of the seat frame 104 relative to the support base 102 can be transmitted from the first coupling element 117 to the second coupling element 124 through contact between the handle 148 and an edge of the slot 119 of the first coupling element 117.

If a user wants to block the seat frame 104 on the support base 102, the seat frame 104 first must be oriented to a position where the handle 148 is in alignment with the protuberance 162. By pulling the handle 148 downward, the catch 146 can disengage from the rib 147, and the anti-rotation lock 134 can then slide downward to a lower position (i.e., the first position previously mentioned and shown with phantom lines in FIG. 7) where the protuberance 162 is lodged in the gap 144 between the two restricting flanges 142.

In this position, the restricting flanges 142 are placed adjacently against two opposite lateral sides of the protuberance 162. As a result, any rotation of the second coupling element 124 (and the first coupling element 117 and seat frame 104 locked therewith) about the rotation axis Y can be blocked owing to abutment between the protuberance 162 and of either of the restricting flanges 142.

When the chair structure 100 is not used, the user can disassemble the chair structure 100 by pushing the latch 150, in particular the protruding flange 154, to cause inward deflection of the tab portion 152. As a result, the flange 154 can disengage from the hole 156, and the latch 150 thereby unlocks the connection between the first and second coupling elements 117 and 124. The seat frame 104 and the first coupling element 117 fixed thereon can then be pulled upward away from the support base 102 and the pivot link assembly 106. The seat frame 104 can then be stored separately from the support base 102.

At least one advantage of the chair structure described herein is the ability of the seat frame to assemble on and separate from the support base in a convenient manner. Such feature may be particularly advantageous when the seat frame can also folded into a compact form, allowing convenient storage of the chair structure in a reduced space. In addition, when the seat frame is assembled with the support base, rotation of the seat frame can also be selectively enabled or blocked for providing safer use of the chair structure.

Realizations in accordance with the present invention therefore have been described only in the context of particular embodiments. These embodiments are meant to be illustrative and not limiting. Many variations, modifications, additions, and improvements are possible. Accordingly, plural instances may be provided for components described herein as a single instance. Structures and functionality presented as discrete components in the exemplary configurations may be implemented as a combined structure or component. These and other variations, modifications, additions, and improvements may fall within the scope of the invention as defined in the claims that follow.

What is claimed is:

1. A chair structure comprising:

a seat frame having a first coupling element; and a support base including a pivot axle fixed thereon and a second coupling element pivotally assembled about the pivot axle, the pivot axle being received at least partially in the second coupling element, wherein the second coupling element includes a latch operable to:

lock the first coupling element with the second coupling element when the seat frame is assembled with the support base, and unlock the first coupling element from the second coupling element for allowing separation of the seat frame from the support base;

wherein the seat frame and the first and second coupling elements are operable to rotate in unison relative to the pivot axle when the first and second coupling elements are locked with each other by the latch, and the first coupling element is removed from the second coupling element when the seat frame is detached from the support base, the second coupling element being held with the pivot axle on the support base when the seat frame and the first coupling element are removed from the support base.

2. The chair structure according to claim 1, wherein the first coupling element includes a hole through which the latch is engaged to lock the first coupling element with the second coupling element.

3. The chair structure according to claim 2, wherein the latch includes a resilient tab portion, and a flange protruding from the tab portion that engages through the hole of the first coupling element when the latch locks the first coupling element with the second coupling element.

4. The chair structure according to claim 3, wherein the tab portion is deflectable in a radial direction relative to the pivot axle for either engaging or disengaging the latch.

5. The chair structure according to claim 1, wherein the second coupling element further includes an anti-rotation lock movable along a direction substantially parallel with the pivot axle for either blocking or allowing rotation of the seat frame about the pivot axle, when the seat frame is assembled with the support base.

6. The chair structure according to claim 5, wherein the second coupling element includes a sleeve having a pocket through which the anti-rotation lock is assembled in sliding relationship.

7. The chair structure according to claim 5, wherein the anti-rotation lock includes a handle that protrudes radial through a slot of the first coupling element when the seat frame is assembled with the support base.

8. The chair structure according to claim 7, wherein a rotation movement of the seat frame relative to the support base is transmitted from the first coupling element to the second coupling element through contact between the handle and an edge of the slot of the first coupling element.

9. The chair structure according to claim 5, wherein an end portion of the anti-rotation lock includes restricting flanges, the restricting flanges being positioned adjacent to opposite sides of a protuberance on the support base when the anti-rotation lock is moved toward the support base to a first position for blocking rotation of the seat frame.

10. The chair structure according to claim 1, wherein the second coupling element is pivotally mounted around the pivot axle via at least one bearing.

11. The chair structure according to claim 1, wherein the support base includes a cushion pad against which abuttal flanges provided on the second coupling element abut for delimiting an angular rotation of the seat frame.

12. The chair structure according to claim 1, wherein the first coupling element has a hollow inner volume in which the second coupling element is received when the seat frame is assembled with the support base.

13. A chair structure comprising:

a seat frame having a first coupling element;

a support base including a pivot axle fixed thereon, and a second coupling element pivotally assembled about the pivot axle and including a latch and an anti-rotation lock, the latch being operable to:

lock the first coupling element with the second coupling element when the seat frame is assembled with the support base, and unlock the first coupling element from the second coupling element for allowing separation of the seat frame from the support base;

the anti-rotation lock being movable along a direction substantially parallel with the pivot axle for either blocking or allowing rotation of the seat frame about the pivot axle, when the seat frame is assembled with the support base, wherein an end portion of the anti-rotation lock includes a catch that detachably fastens with a portion of the second coupling element when the anti-rotation lock is moved away from the support base to a second position for allowing rotation of the seat frame.

14. The chair structure according to claim 13, wherein the second coupling element includes a sleeve having a pocket through which the anti-rotation lock is assembled in sliding relationship.

15. The chair structure according to claim 13, wherein the anti-rotation lock includes a handle that protrudes radial through a slot of the first coupling element when the seat frame is assembled with the support base.

16. The chair structure according to claim 13, wherein another end portion of the anti-rotation lock includes restricting flanges, the restricting flanges being positioned adjacent to opposite sides of a protuberance on the support base when the anti-rotation lock is moved toward the support base to a first position for blocking rotation of the seat frame.

17. The chair structure according to claim 13, wherein the seat frame and the first and second coupling elements are operable to rotate in unison relative to the pivot axle when the first and second coupling elements are locked with each other by the latch, and the first coupling element is removed from the second coupling element when the seat frame is detached from the support base.

18. A method of assembling and disassembling a chair structure including a seat frame and a support base, the method comprising:

providing a seat frame having a first coupling element, wherein the first coupling element has a hole;

providing a support base having a pivot axle and a second coupling element pivotally mounted around the pivot axle, wherein the second coupling element includes a latch thereon, and the pivot axle is received at least partially in the second coupling element;

assembling the seat frame with the support base by sliding the first coupling element over the second coupling element until the latch engages through the hole for locking the first coupling element with the second coupling element, wherein the seat frame and the first and second coupling elements are rotatable in unison relative to the pivot axle when the first and second coupling elements are locked with each other by the latch;

unlocking the first coupling element from the second coupling element; and removing the seat frame and the first coupling element from the support base and the second coupling element, the second coupling element being held with the pivot axle on the support base when the seat frame and the first coupling element are removed from the support base.

19. The method according to claim 18, wherein the latch includes a resilient tab portion, and a flange protruding from the tab portion that engages through the hole of the first coupling element when the first coupling element is locked with the second coupling element.

20. The method according to claim 19, wherein the step of unlocking the first coupling element from the second coupling element includes:

pushing the flange in a radial direction for unlocking the first coupling element from the second coupling element.

21. The method according to claim 18, wherein the second coupling element further includes an anti-rotation lock movable along a direction substantially parallel with the pivot axle, the anti-rotation lock including a handle that protrudes radial through a slot of the first coupling element.

22. The method according to claim 21, further comprising moving the anti-rotation lock toward the support base until restricting flanges provided on a first end portion of the anti-rotation lock are positioned adjacent to a protuberance on the support base, whereby blocking rotation of the seat frame relative to the support base.

23. The method according to claim 22, further comprising moving the anti-rotation lock away from the support base until a catch provided on a second end portion of the anti-rotation lock fastens with a portion of the second coupling element, whereby allowing rotation of the seat frame about the pivot axle relative to the support base.

24. The method according to claim 23, wherein the step of moving the anti-rotation lock away from the support base causes the restricting flanges to move away from the protuberance on the support base.

* * * * *